US011134791B2

(12) United States Patent
Hutton

(10) Patent No.: US 11,134,791 B2
(45) Date of Patent: Oct. 5, 2021

(54) SELECTIVELY ELEVATED FOUNDATION FOR A MATTRESS

(71) Applicant: Get To Industries LLC, Columbia City, OR (US)

(72) Inventor: William B. Hutton, Columbia City, OR (US)

(73) Assignee: Get To Industries LLC, Columbia City, OR (US)

( * ) Notice: Subject to any disclaimer, the term of this patent is extended or adjusted under 35 U.S.C. 154(b) by 0 days.

(21) Appl. No.: 17/143,942

(22) Filed: Jan. 7, 2021

(65) Prior Publication Data

US 2021/0196052 A1 Jul. 1, 2021

Related U.S. Application Data

(63) Continuation-in-part of application No. 16/732,124, filed on Dec. 31, 2019, now abandoned.

(51) Int. Cl.
*A47C 23/00* (2006.01)
*A47C 23/06* (2006.01)

(52) U.S. Cl.
CPC ..... *A47C 23/005* (2013.01); *A47C 23/062* (2013.01)

(58) Field of Classification Search
CPC ..... A47C 19/005; A47C 19/027; A47C 19/25; A47C 23/00; A47C 23/06; A47C 23/061; A47C 23/062
USPC ..... 5/207, 238
See application file for complete search history.

(56) References Cited

U.S. PATENT DOCUMENTS

| | | | | |
|---|---|---|---|---|
| 572,600 | A | 12/1896 | Foster | |
| 2,638,606 | A | 5/1953 | Austin | |
| 5,184,802 | A | 2/1993 | Galumbeck | |
| 6,701,551 | B1 | 3/2004 | Antinori | |
| 7,003,822 | B1 * | 2/2006 | Sheehy | A47C 19/005 5/200.1 |
| 2010/0154118 | A1 | 6/2010 | Pearce | |
| 2014/0144808 | A1 | 5/2014 | Anderson | |

(Continued)

OTHER PUBLICATIONS

Screen Shot of "GhostBed KD Foundation Box Spring Assembly Instructions", GhostBed, https://www.youtube.com/watch?v=oD-20AeUESQ, May 5, 2016, 3 pages.

(Continued)

*Primary Examiner* — David R Hare
*Assistant Examiner* — Adam C Ortiz
(74) *Attorney, Agent, or Firm* — Chernoff Vilhauer LLP

(57) ABSTRACT

A mattress foundation for inclusion as part of a bed, to support a mattress, such as one of the type made of foam material and usually marketed and shipped in a compressed, reduced-sized configuration. The mattress foundation is configured to be marketed and shipped to a purchaser as a set of subassemblies and parts that are contained together in a compact package and can be assembled without use of tools. The set of mattress foundation subassemblies and parts can be packed and shipped in a rectangular box made of material such as corrugated cardboard that may be flattened out and incorporated in the mattress foundation. The package in which the subassemblies and parts are contained is small enough to be carried up stairways and through passageways to a bedroom where a bed incorporating the mattress foundation is to be set up for use.

9 Claims, 10 Drawing Sheets

(56) References Cited

U.S. PATENT DOCUMENTS

| | | | | |
|---|---|---|---|---|
| 2016/0143446 | A1 | 5/2016 | Hartley | |
| 2018/0140103 | A1 | 5/2018 | Thompson | |
| 2018/0372138 | A1* | 12/2018 | Li | A47C 19/20 |

OTHER PUBLICATIONS

Screen Shot of "Classic Brands High-Profile Instant Foundation Assembly Instructions", Classic Brands LLC, https://www.youtube.com/watch?v=yWuyA4xV9TA; Oct. 9, 2017, 4 pages.
Screen Shot of "How to assemble the Foundation", Casper, https://www.youtube.com/watch?v=nCfdJn5ka7A, Oct. 8, 2019, 3 pages.

* cited by examiner

SELECTIVELY ELEVATED FOUNDATION FOR A MATTRESS

CROSS-REFERENCE TO RELATED APPLICATIONS

This application is a continuation-in-part (CIP) application of U.S. patent application Ser. No. 16/732,124, filed on Dec. 31, 2019 and entitled FOUNDATION FOR A MATTRESS. The complete disclosure of the above application is hereby incorporated by reference for all purposes.

BACKGROUND OF THE INVENTION

The present application relates to a foundation for a mattress for a bed, and in particular relates to a foundation that can be shipped in a ready-to-assemble configuration in a compact, easily-handled package.

Traditional inner-spring mattresses are large and bulky and therefore are difficult and awkward to move. In recent years increasing numbers of mattresses being sold are made of a resilient foam and spring construction, with an appropriate protective and decorative outer cover. Such mattresses can be shipped in a compact, compressed configuration. The package containing such a compressed mattress is small enough to be carried easily to a buyer's bedroom, where the package can be opened to allow the mattress to expand to full size.

While a foundation is typically used with such mattresses, these supporting platforms are typically made of wood with an attractive outer cover. Such a mattress foundation, unlike the compressed mattress, is a large, unwieldy, piece that must be moved into place to support the mattress. Such mattress foundations have conventionally included structural frame portions providing vertical support along the top end and bottom end, both sides, and along a central longitudinal line.

Because of the size and volume of the conventional mattress foundation for use with a mattress, even though the weight of such a foundation is not particularly great, shipping and handling costs for an assembled foundation can be a significant part of the retail price of beds including mattresses. While foundations for beds including mattresses can be constructed near a market area, there are undesirable costs for foundation assembly in locations far from the bed manufacturer's base location, including costs of local delivery and installation.

What is desired, then, is a mattress foundation that can be transported economically, that can be packed so as to be handled relatively easily during shipment and during movement within a purchaser's home, and that can be assembled and installed easily to support a newly-purchased mattress.

SUMMARY OF THE INVENTION

The present invention, as defined by the claims which form a part of the present disclosure, provides a mattress foundation that can be shipped in a compact package and that can be quickly assembled and easily readied for use to support a mattress without the use of tools.

In one embodiment, the mattress foundation disclosed herein includes a frame with end assemblies and side beam assemblies that are fastened together by easily-installed connectors.

In one embodiment, the end assemblies and the side beam assemblies of the frame of the mattress foundation disclosed herein can all be nested and fastened together in a compact package, small enough to be carried conveniently to a location where a bed incorporating the mattress foundation is to be set up.

In one embodiment of the mattress foundation disclosed herein, transversely-oriented mattress-supporting members are supported and held in place by hangers attached to the side beam assemblies of the outer frame of the mattress foundation.

In one embodiment of the mattress foundation disclosed herein, packaging material, in which subassemblies of the mattress foundation frame are contained during shipment, can be incorporated in the mattress foundation.

In one embodiment, the mattress foundation disclosed herein includes a cover that fits over the assembled mattress foundation frame and helps to hold the end assemblies and side beam assemblies together, while providing a pleasing appearance and a smooth, durable outer surface.

The foregoing and other objectives and features of the invention will be more readily understood upon consideration of the following detailed description of the invention taken in conjunction with the accompanying drawings.

DETAILED DESCRIPTION OF PREFERRED EMBODIMENTS

Figure 1:
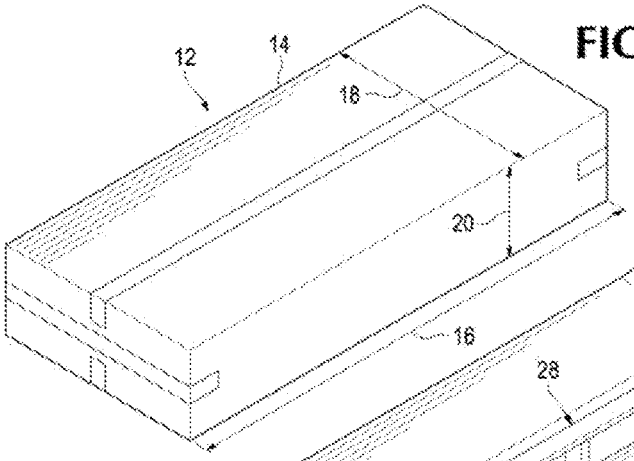
FIG. 1 is an isometric view of a compact package holding a foundation for a mattress, in a ready-to-assemble configuration and with its component parts nested compactly in a package of a size that can be conveniently handled and transported.
Figure 2:
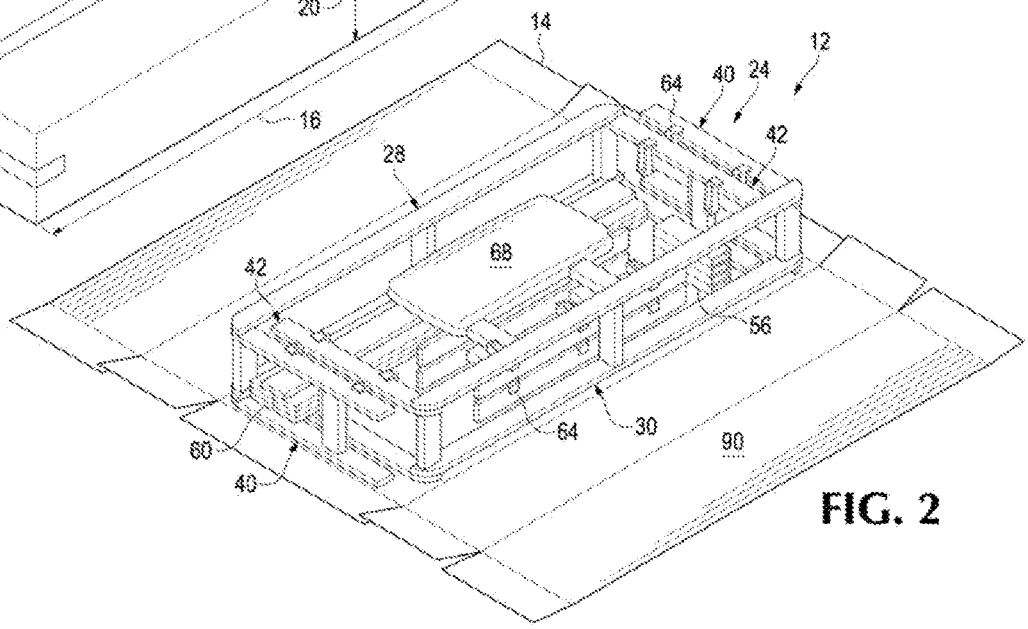
FIG. 2 is an isometric view of the ready-to-assemble mattress foundation shown in FIG. 1, showing the component parts resting on the outspread material of which the package is constructed, and arranged as they are contained in the package during shipment.

Referring now to the drawings that form a part of the disclosure herein, in FIG. 1 a compact generally rectangular package 12 has an exterior layer 14 which may be of strong corrugated cardboard. The package 12 contains the compactly arranged components of a mattress foundation 24, as shown in FIG. 2, that are ready to be assembled to support a mattress. Such a foundation 24 can be particularly useful for a mattress of the kind typically packaged and delivered to a purchaser in a compressed form, in a package much smaller than the mattress will be when in use. The package 12 for a foundation for a queen size mattress thus may have a length of 16 of 61 inches, a width 18 of 25½ inches, and a height 20 of 9½ inches, for example. The package 12 containing the ready-to-assemble foundation 24 is thus small enough to be carried conveniently within a house or apartment to a bedroom where the bed is to be erected and used and is small enough to be stored and transported in a space only 20-25% as large as is required for a conventional mattress foundation.

Figure 3:
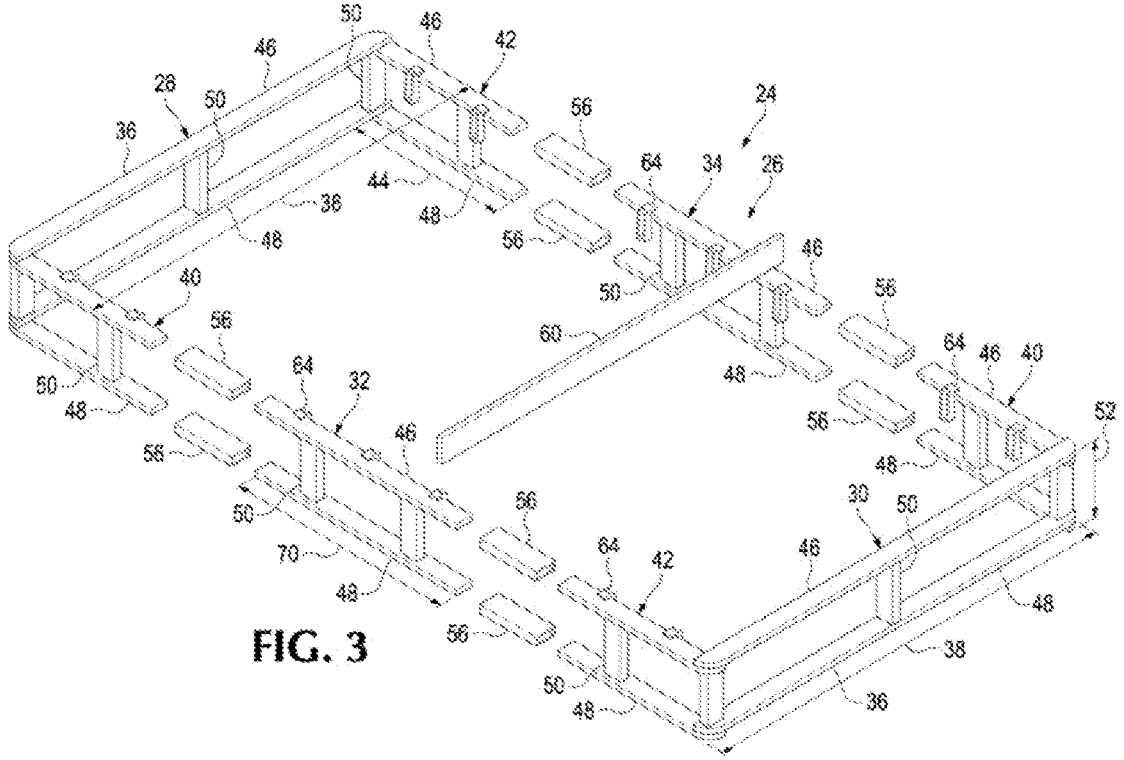
FIG. 3 is an isometric view of the mattress foundation frame members and frame member connectors of the mattress foundation shown in FIG. 2, aligned with one another as they will be connected with one another.
Figure 4:
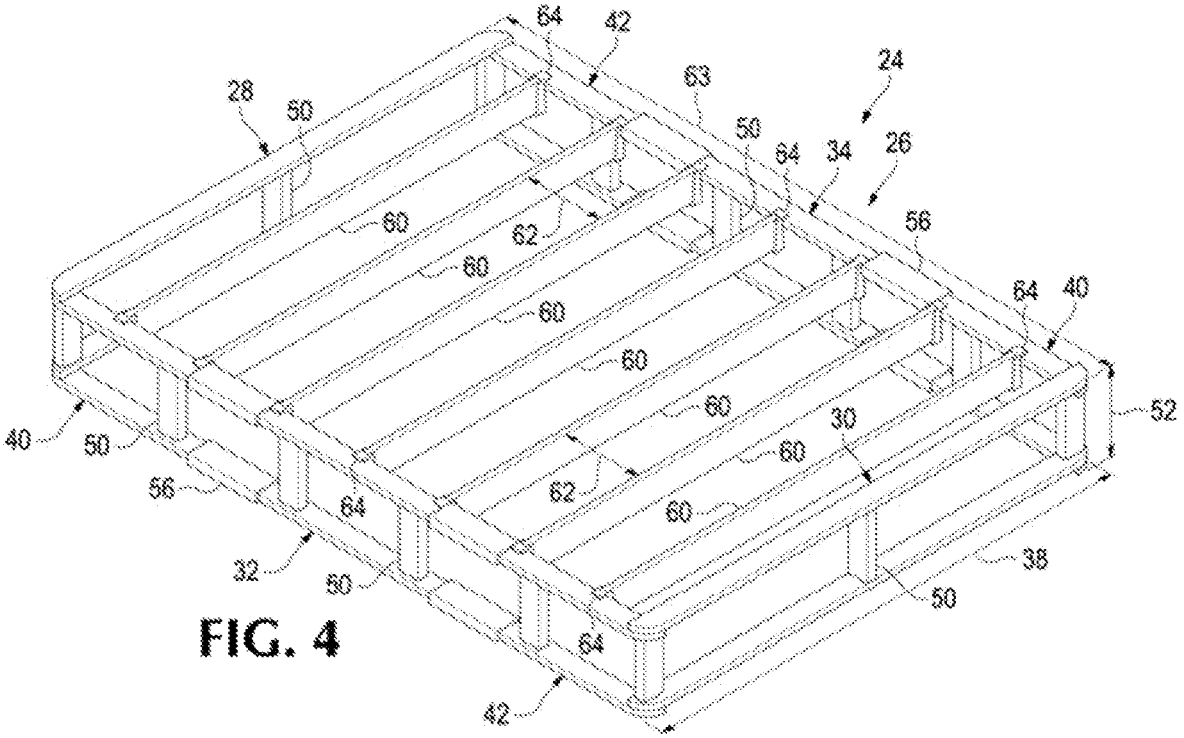
FIG. 4 is an isometric view of the assembled frame of the mattress foundation shown in FIGS. 2 and 3, together with transversely oriented mattress support members supported by the frame.

As may be seen in FIGS. 2, 3, and 4, the mattress foundation 24 has a frame 26 that includes a pair of opposite first and second frame end assemblies, a head frame end assembly 28 and a foot frame end assembly 30, and a pair of oppositely located first and second frame side beam assemblies 32 and 34. Unless explicitly excluded, the mattress foundation 24 may include one or more components of other mattress foundations of the present disclosure. The frame end assemblies 28 and 30 may be seen best in FIGS. 2 and 3. Each includes an end beam portion 36 having a width 38, in a direction corresponding with the width of a mattress to be supported by the mattress foundation 24, that may be equal to the full width of the frame 26 of the mattress foundation. Stub side beams 40 and 42 extend at right angles from respective ends of the end beam portions 36 and are thus parallel with each other and extend in a direction corresponding with the length of a mattress to be supported on the mattress foundation 24. The stub side beams 40 and 42 of the mattress foundation 24 are thus spaced apart from each other so as to determine the width of the frame 26 of the mattress foundation 24. While the stub side beams 40 and 42 are shown herein as extending by equal lengths 44 away from the end beam portions 36, it will be understood that equal length is not critical, so long as the corresponding side beam assemblies 32 and 34 are respectively of appropriate lengths. In some embodiments, the side beam assemblies may interconnect the first and second frame end assemblies with each other, where each side beam assembly may extend in a lengthwise direction with respect to the mattress foundation, and each side beam assembly may have a pair of opposite ends, and each of the opposite ends of each of the side beam assemblies may be interconnected with one of the frame end assemblies.

Each of the opposite frame end assemblies and opposite frame side beam assemblies includes respective top rails 46 and bottom rails 48 aligned parallel with one another, separated and interconnected by vertical spacer members 50 that establish the height 52 of the mattress foundation frame 26 and keep the top and bottom rails 46 and 48 parallel with each other in each of the frame end assemblies 28 and 30, the stub side beams 40 and 42, and the frame side beam assemblies 32 and 34. The top rails 46 and bottom rails 48 may be of suitable dimensional lumber having uniform dimensions for each of the several segments included in the mattress foundation 24. In the mattress foundation 24 shown in FIGS. 2-4 the height 52 is 9 inches, but the height of a foundation can be determined by the manufacturer. Currently available foundations range in height from 3 inches to 12 inches. The bottom rails 48 of the side beam assemblies 32 and 34 and the stub side beams 40 and 42 extend longitudinally, with their respective ends located beneath the transversely-extending bottom rails 48 of the head and foot frame end assemblies 28 and 30. Similarly, the transversely-extending top rails 46 of the head and foot frame end assemblies 28 and 30 overlap and rest atop the ends of the top rails 46 of the stub side beams 40 and 42.

As may be seen in FIGS. 3 and 4, the frame end assemblies 28 and 30 may be connected with the stub side beam portions 40 and 42 of the frame side beam assemblies 32 and 34 using conventional fasteners to form part of the frame 26 of the mattress foundation 24. The respective top and bottom rails 46 and 48 of the side beam assemblies 32 and 34 and the stub side beams 40 and 42 are aligned with each other and fastened together end-to-end by connectors 56 that fit snugly around each of the top and bottom rails 46 and 48.

Several transversely-extending mattress support members 60 having a narrow surface and a wide surface in relation to the narrow surface are located between and supported by the top rails 46 of the side beam assemblies 32 and 34 and the stub side beams 40 and 42. The mattress support members 60 are preferably parallel with each other, and remain largely parallel to the width of the mattress and mattress foundation, and are spaced apart from one another by an appropriate distance 62. The distance 62 between transversely-extending mattress support members 60 will be determined by the foundation manufacturer, and may generally be between 3 and 8 inches, for example, along the length 63 of the frame 26 of the mattress foundation 24. Mattress support members 60 may be supported by hangers 64 that will be described in greater detail below. In a preferred embodiment, the transverse mattress support members extend between the side beam assemblies, and each mattress support member may have a pair of opposite ends, and a narrow surface and a wide surface in relation to the narrow surface. Further, each of the opposite ends may be supported by a respective one of the side beam assemblies, and multiple hangers may be mounted on each of the side beam assemblies, and the hangers may carry respective ends of the transverse mattress support members, where the narrow surface of the support members face upward.

There are enough mattress support members 60, and the distance 62 between adjacent mattress support members is small enough, so that there is ample support for a mattress with people supported on the mattress. Since about 70% of a person's weight is typically supported by the center third of the length of a mattress, the spacing 62 may desirably be less in the center third of the length of the foundation, thus in the side beam assemblies 32 and 34, than in the stub side beams 40 and 42. This provides better support for a mattress in that part of the bed so that the mattress has an apparent increase in firmness.

Referring again to FIG. 2, the head frame end assembly 28 and foot frame end assembly 30 may be arranged facing each other in the package 12, with the stub side beams 40 and 42 of the two frame end assemblies 28 and 30 lying alongside each other at each end of the package 20. The frame side beam assemblies 32 and 34 may be of equal lengths and may be short enough to fit between the stub side beams 40 and 42 of the head and foot frame end assemblies 28 and 30 in the package 12. In some configurations it may be convenient for the top and bottom rails 46 and 48 of the frame side beam assemblies 32 and 34 to extend between the top rails 46 and the bottom rails 48 of one or more of the stub side beams 40 and 42 in the package 12. The combined lengths of the two stub side beams 40 and 42 and a respective frame side beam assembly 32 or 34, together with the top and bottom rails 46 and 48 of the transversely extending end beam portions 36 of the respective frame end assemblies 28 and 30, establish the length 63 of the mattress foundation frame 26. The transverse mattress support members 60 may be stacked together and packed parallel with the end beam portions 36 of the frame end assemblies 28 and 30, extending between the top and bottom rails 46 and 48 of at least one of the stub side beams 40 and 42 in the package 12. The hangers 64 for the mattress support members may be already attached to the top rail members 46 of the frame side beam assemblies 32 and 34 and the stub side beams 40 and 42 at the appropriate locations. The lengths of the stub side beams 40 and 42 and the frame side beam assemblies 32 and 34 can be designed to provide enough room for the side beam assemblies and the transverse mattress support members to fit within a package of minimal size, together with the connectors 56 that will interconnect the frame side beam assemblies 32 and 34 with the stub side beams 40 and 42, and together with a folded cover 68 for the foundation frame in the package 12. At the minimum, however, there must be stub side beam top and bottom rails 46 and 48 long enough to fully engage the connector 56.

Thus, in a foundation 24 for a queen size mattress, nominally 60 inches wide and 80 inches long, the length 44 of each stub side beam may be 25 inches, including the widths of the rails 46 and 48 of the frame end assemblies 28 and 30, and the length 70 of each side beam assembly 32 and 34 may be 30 inches.

The nominal size for a king size mattress is a width of 76 inches and a length of 80 inches. For a California king size mattress the nominal measurements are 72 inches wide by 84 inches long. The nominal size for a twin size mattress is 39 inches wide by 75 inches long. A twin extralong is nominally 39 inches wide by 80 inches long. The nominal size for a full, or double, bed mattress is 54 inches wide by 75 inches long. As shown in the following TABLE 1, the frame end assemblies 28 and 30, stub side beams 40 and 42, and frame side beam assemblies 32 and 34 may have respective lengths that will enable the subcomponents of the mattress foundation frame 26 to be arranged for shipment and delivery in a compact package 12 of the dimensions mentioned above.

TABLE 1

| Mattress Size Description and Nominal Dimensions | Frame and Assembly Width | Stub Side Beam Lengths | Side Beam Assembly Length |
|---|---|---|---|
| Queen (W) 60 inches × (L) 80 inches | 60 inches | 50 inches in total, or 25 inches each | 30 inches |

TABLE 1-continued

| Mattress Size Description and Nominal Dimensions | Frame and Assembly Width | Stub Side Beam Lengths | Side Beam Assembly Length |
|---|---|---|---|
| King (W) 76 inches × (L) 80 inches | 76 inches (2 × 38) | 50 inches in total, or 25 inches each | 30 inches |
| California King (W) 72 inches × (L) 84 inches | 72 inches (2 × 36) | 50 inches in total, or 25 inches each | 34 inches |
| Double (Full) (W) 54 × (L) 75 | 54 inches | 50 inches in total, or 25 inches each | 25 inches |
| Twin (W) 38 × (L) 75 | 38 inches | 50 inches in total, or 25 inches each | 25 inches |
| Twin (Extra Long) (W) 39 × (L) 80 | 38 inches | 50 inches in total, or 25 inches each | 30 inches |

Figure 7:
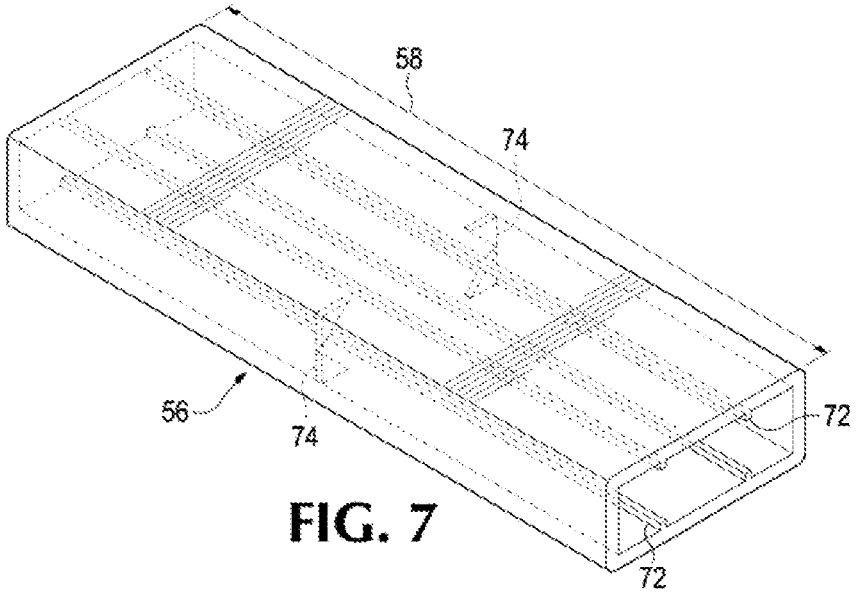
FIG. 7 is an isometric view of one of the connectors used to fasten the side beam assemblies together with the end assemblies of the foundation.

As may be seen in FIG. 7, a suitable connector 56 may be a rectangular tube of a molded plastics material that is suitably strong, tough, somewhat flexible, and hard enough to press into a surface of a board of wood of which one of the rails 46 or 48 of the mattress foundation frame 26 may be constructed. For example, a plastics material such as high density polyethylene, polypropylene and other types of plastic or metal may be molded to be used as a suitable connector 56. Preferably, the connector 56 will be in the form of a tube of a size designed to fit snugly around the rails 46 or 48 being connected. Narrow ridges 72 may be provided, extending lengthwise and projecting inwardly in the tube from the top and bottom, so as to engage and dig into the surfaces of the rails 46 and 48 as they are pushed into the connector 56 from its opposite ends. The connectors 56 should have a length 58 great enough to keep the connected rails 46 or 48 aligned with each other. For example, the length 58 could be 9 inches, although a length 58 in the range of at least 3 inches up to 12 inches could be used. Preferably, small gussets 74 may be provided in the corners of the tube in a coplanar arrangement at mid-length of the connector, as stops to prevent the connector 56 from moving farther onto one or the other of a pair of rails 46 or 48 being connected and thus position the connector 56 so that it extends evenly onto each of the rails being connected.

Figure 7A:
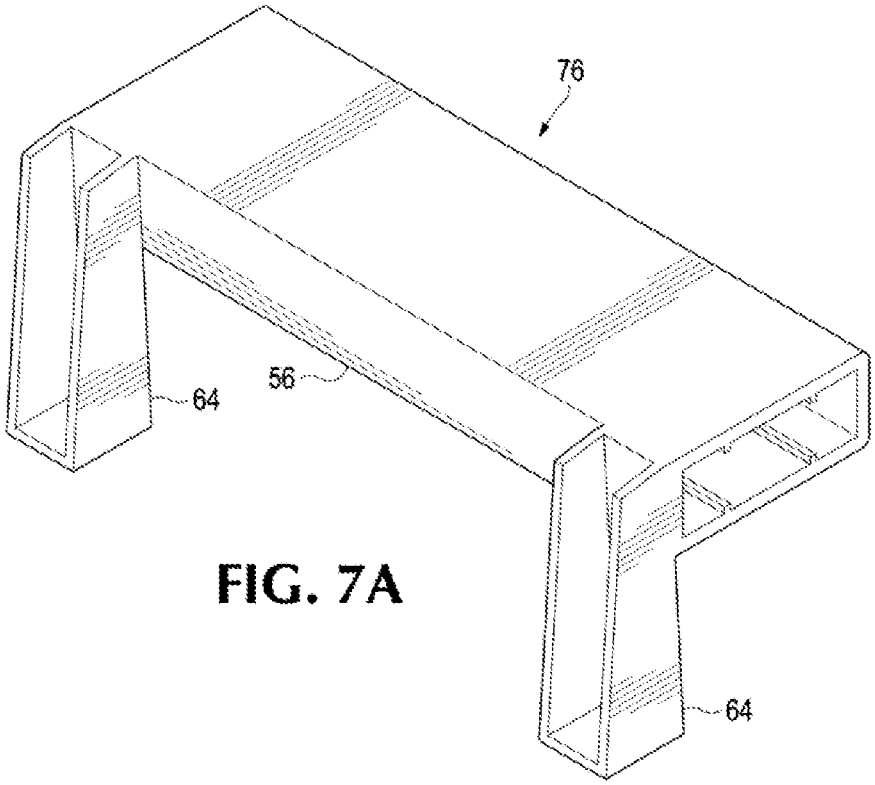
FIG. 7A is an isometric view showing the connector of FIG. 7 and two of the hangers shown in FIGS. 5 and 6 integrated with the connector.

As shown in FIG. 7A, two of the hangers 64 may be combined with a connector 56 to form an integrated member 76. One or more of the other mattress foundations of the present disclosure may also include the same or similar connection provided by the integrated member 76. Similar to the hangers and the connector 56, the integrated member 76 may be of suitably strong and tough molded plastics material. In a preferred embodiment, the connector may have a length, opposing ends and a channel extending through the length of the connector, where the channel is wide enough at the opposing ends to incorporate each end of each side beam assembly to a respective one of the frame end assemblies. As shown in FIG. 7A, the surface of the channel may also have protruding ribs extending longitudinally along the length of the connector, so that side beam assemblies may be easily assembled and interconnected.

In assembling the frame 26 the connectors 56 may initially be pushed a small distance onto the ends of the top and bottom rails 46 or 48 to loosely connect the frame side beam assemblies 32 and 34 with the frame end assemblies 28 and 38. The frame end assemblies may then be pushed toward each other until the top and bottom rails 46 and 48 all extend fully into the connectors 56 and are abutted closely against one another, to complete assembly of the frame 26.

The hangers 64 that locate and support the transversely oriented mattress support members 60 are attached to the top rails 46 of the stub side beams 40 and 42 and the top rails 46 of the frame side beam assemblies 32 and 34, as may be seen in FIGS. 2, 3, 4, and 8. The transversely oriented mattress support 60 members are supported by the hangers 64 and extend transversely across the width of the outer frame, between the stub side beams 40 and 42 and between the frame side beam assemblies 30 and 32.

Figure 5:
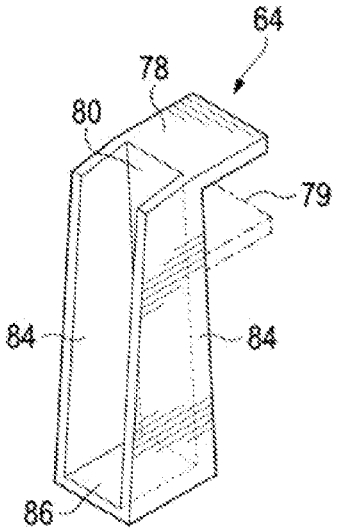
FIG. 5 is an isometric view of one of the hangers used as shown in FIG. 4 to support transverse mattress support members.
Figure 6:
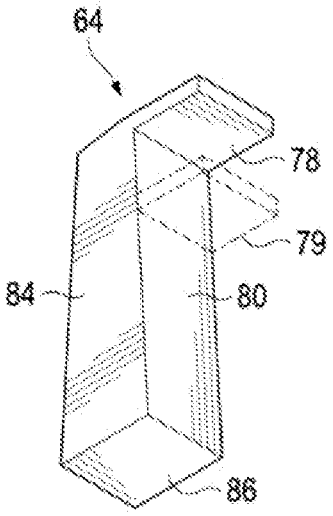
FIG. 6 is an isometric view of the hanger shown in FIG. 5, taken from an opposite point of view.
Figure 8:
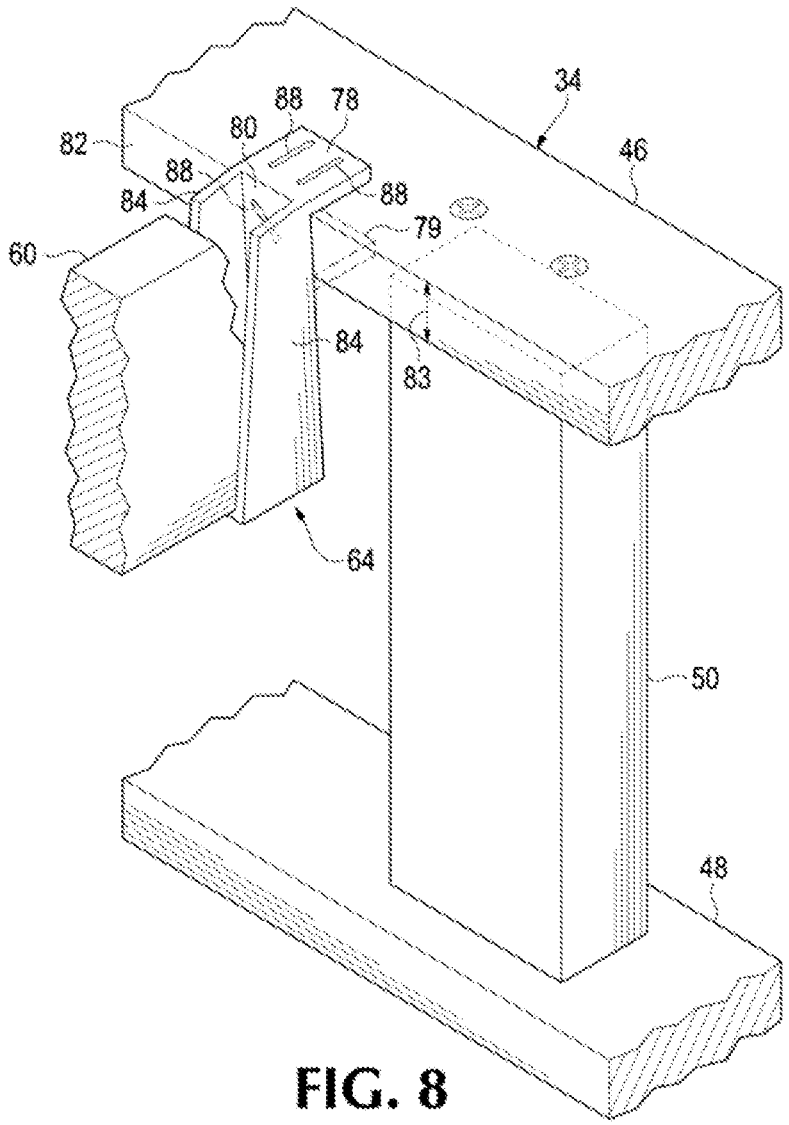
FIG. 8 is a partially cut-away isometric detail view, at an enlarged scale, of a portion of the frame of the mattress foundation shown in FIG. 4, showing the attachment of a transversely extending mattress support member to the outer frame using the hanger shown in FIGS. 5 and 6.

The hangers 64, shown clearly in FIGS. 5 and 6, may be of suitably strong and tough molded plastics material such as that of the connectors 56. Each hanger 64 may include an ear 78 that extends perpendicularly away from an upper end of a back member 80 intended to hang vertically along an inner face 82 of a top rail member 46. An additional ear 79, shown in broken line in FIGS. 5, 6, and 8, may also extend perpendicularly away from the back member 80 and parallel with the ear 78, at a location spaced apart from the ear 78 by a distance equal to the thickness 83 of a top rail member 46 to which the hanger is attached, as shown in FIG. 8. A pair of parallel side members 84 and a bottom member 86 extend perpendicularly from the back member 80, forming a pocket, open upwardly and toward the interior of the foundation frame 26, in which to receive an end of a mattress support member 60. The side members 84 of the hanger 64 may be tapered slightly to be wider at the bottom of the hanger 64, extending further from the back member 80, so that the pocket is deeper at the bottom of the hanger 64. As may be seen in FIG. 8, the hangers 64 are attached to a top rail member 46 with the ear 78 extending across the top face of the top rail 46 and fastened in place by, for example, a pair of heavy duty staples 88. An additional staple 88 may also be placed through the back member 80 of a hanger 64 and into the inner face 82 of the top rail 46.

The mattress support members 60 are supported with their respective ends held in the hangers 64, either simply by gravity, or possibly by an elastic grip of the side members 84 of the pocket against the wider surfaces of the mattress support members 60. The mattress support members 60 may be of dimensional lumber, such as nominal 1"×4" or 1"×2" boards (with actual thickness and width dimensions somewhat smaller), of the appropriate length. The particular size may be determined by the foundation manufacturer. The mattress support members 60 are held in the hangers 64 with their narrower (e.g., nominal 1") surfaces facing upward, i.e., on edge, so that the mattress support members can act as deep beams to resist bending downwardly under the weight of a person on a bed including the foundation 24. The bending strength obtained by this orientation makes it unnecessary to have a central longitudinally extending beam located in the foundation between and parallel with the frame side beams, thus significantly reducing the cost of the foundation 24 in comparison with a prior wooden mattress foundation having central longitudinally extending beams. As such, the design of eliminating the need of central longitudinally extending beams in the foundation structure has a number of significant benefits, as it can greatly increase the ease of shipping and assembly, all while promoting sustainability and reducing the use of wood materials.

The upper faces of the top rails 46 of the frame end beam assemblies and the upper surfaces of the transversely oriented mattress support members 60 are preferably coplanar. As may be seen in FIG. 9, a sheet 90 of sturdy, somewhat stiff, material may extend over the top of the mattress foundation frame 26 and rest atop the mattress support members 60, thereby loosely interconnecting the mattress support members 60 and potentially spreading forces among the mattress support members 60. The corrugated cardboard or similar material of the outer layer 14 of the package 12 originally containing the ready-to-assemble components of the mattress foundation 24 may be laid out flat, as shown in FIG. 2, and trimmed to an appropriate size to be used as the sheet 90 of material shown atop the mattress foundation frame in FIG. 9. Ideally, the corrugated cardboard or similar material of the outer layer 14 may be marked to show where it should be trimmed for use as the sheet 90. Depending on the length 63 of the foundation frame 26 the corrugated cardboard of the outer layer 14 of the package 12 may not extend over the entire foundation frame, as may be seen in FIG. 9, leaving open areas adjacent the head and foot ends of the frame 26 is acceptable.

Figure 9:
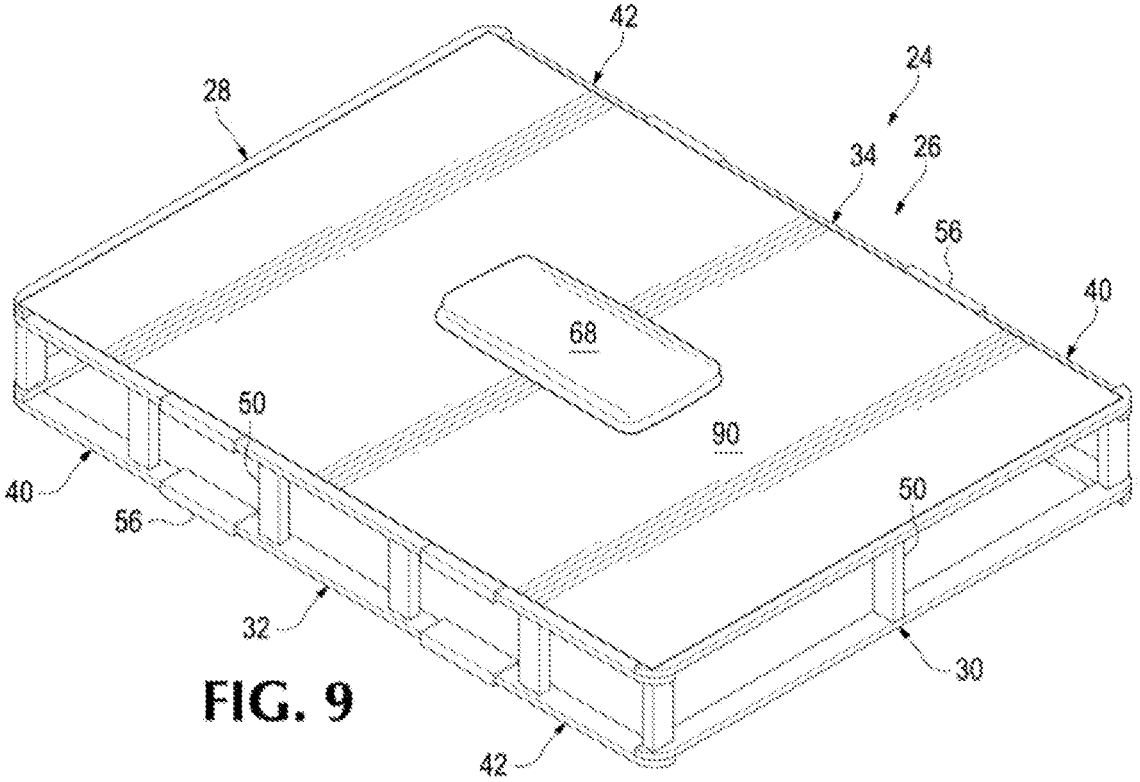
FIG. 9 is an isometric view of the assembled frame, showing a layer of material such as a portion of the corrugated cardboard of which the package is constructed resting on the transverse mattress support members, and with a mattress foundation cover ready to be put into place.

Also in FIG. 9, the cover 68 is shown folded and resting atop the sheet 90 of material. The cover 68 may be of suitably strong woven cloth or other flexible, strong sheet material, and may include a liner layer 92 of padding material, shown in FIG. 11, so that the cover 68 will provide a smooth, somewhat attractive, appearance for the exterior of the mattress foundation 24.

Figure 10:
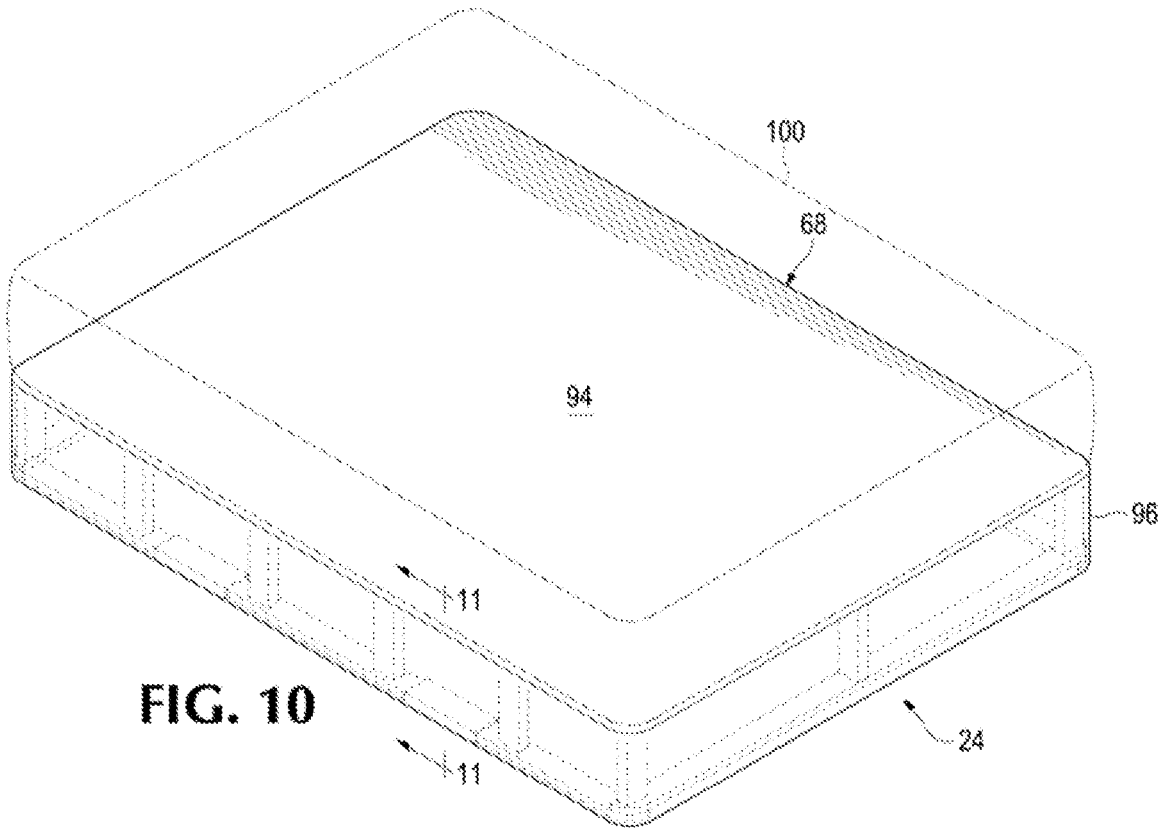
FIG. 10 is an isometric view of the assembled mattress foundation, with a mattress shown in phantom line in place atop the mattress foundation.
Figure 11:
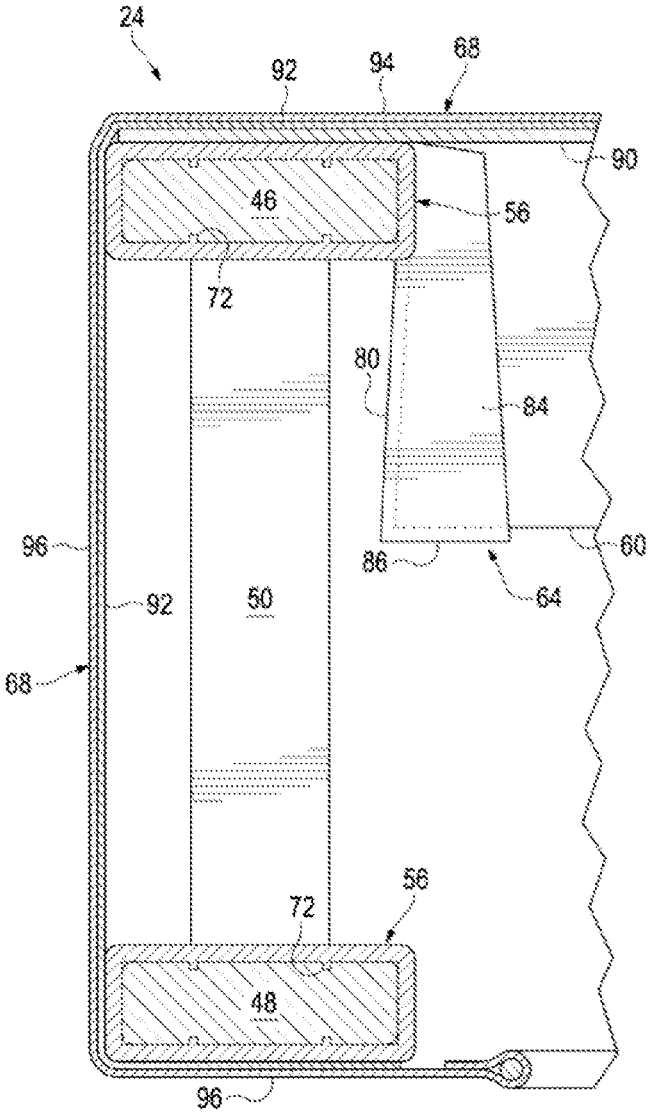
FIG. 11 is a sectional view of a portion of the assembled mattress foundation shown in FIG. 10, taken on line 11-11 in FIG. 10.

As shown in FIGS. 10 and 11, the cover 68 is placed over the entire mattress foundation frame 26, including the mattress support members 60 and the sheet 90 of material shown in FIG. 9. The cover 68 incorporates a flat top member 94 whose dimensions match the size of the foundation frame 26, and a depending skirt portion 96 that extends downward closely along the ends and sides of the mattress foundation frame 26. The cover 68 extending across the top of the mattress foundation provides a familiar surface on which to place the mattress. The skirt portion 96 of the cover 68 is of sufficient depth to extend inwardly beneath the bottom rails 48 of the outer frame 26 of the mattress foundation 24. The skirt portion 96 may include a drawstring 98 or an elastic band or other tightening device along its lower margin, for keeping the cover 68 in place, snugly encircling the entire frame assembly. Alternatively, the cover 68 may simply be tacked, stapled, or similarly fastened to the bottom rails 48 when it is put into place. Since the skirt portion 96 of the cover 68 is fastened securely to the top member 94 and extends downward closely about the ends and sides of the mattress foundation frame 26, the cover 68 helps to keep the frame end assemblies 28 and 30 from working apart from the frame side beam assemblies 32 and 34 and slipping out of the connectors 56.

When the foundation 24 is incorporated in a bed to support a mattress 100, as shown in FIG. 10, the stub side beams 40 and 42 and the frame side beam assemblies 32 and 34, with their associated connectors 56, are normally supported on a bed frame including longitudinal support rails that extend along the sides of the bed frame in position to support substantially the entire length of the mattress foundation 24. For example, the mattress foundation 24 may be supported on a simple bed frame comprising merely a pair of parallel angle iron rails interconnected by suitable transverse members and supported with their horizontal flanges directed inwardly toward each other. The mattress foundation then fits snugly between the vertical flanges of the angle iron rails and is supported by the horizontal flanges. It will be understood that other conventional bedframe structures with inwardly directed longitudinally-extending support rails would also be functionally adequate to support the mattress foundation disclosed herein.

Figure 12:
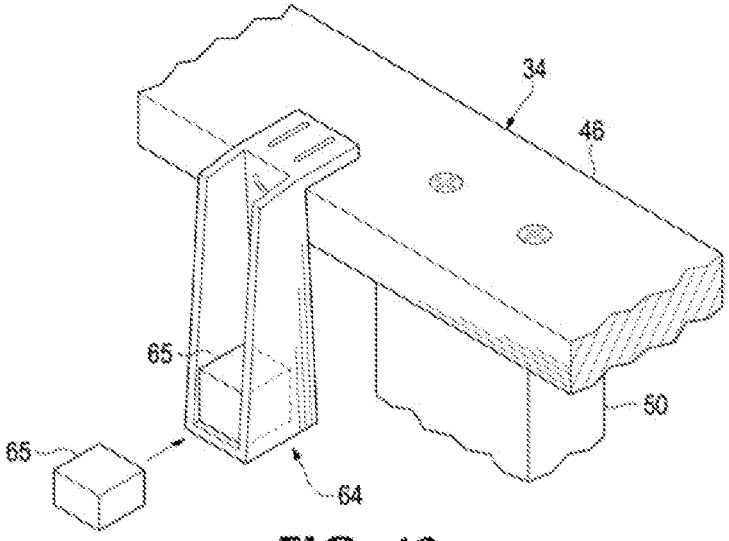
FIG. 12 is an isometric view showing an alternative example of a hanger, and an elevation component which may be inserted within the hanger.
Figure 13:
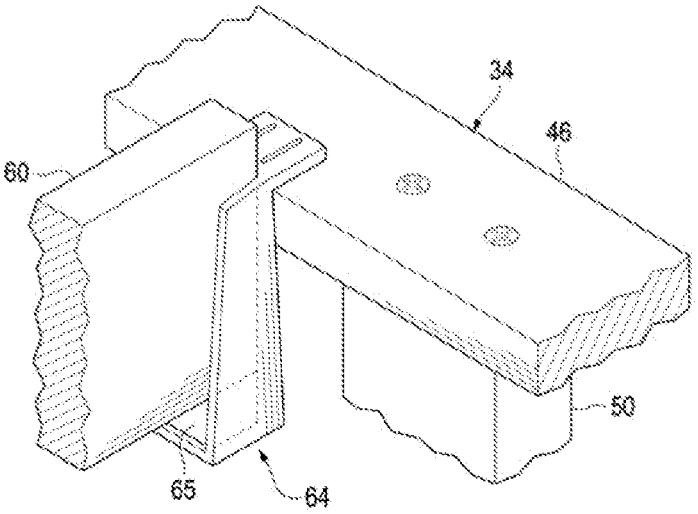
FIG. 13 is an isometric view showing the hanger and elevation component of FIG. 12 with a transverse mattress support member positioned on top of the component.

Referring to FIGS. 12-13, another example of a hanger is shown, which is generally indicated at 64. In this embodiment, there may be an elevation component 65 that may fit in the base of the hanger, where transversely oriented mattress support members 60 may be inserted on directly top of the elevation component 65. The elevation component may have a width that is less than the internal width of the hanger, such that the component may easily fit within the hanger. The height of the elevation component may be any height comfortable to a user when the corrugated cardboard and mattress are placed on top. In a preferred embodiment, the elevation component 65 may resemble a cube, but may resemble other shapes so long as practical for manufacture and assembly. The component may be a molded plastic material that is suitably strong, tough, and hard enough to accept a surface of a board of wood of which one of the transverse support members 60 may be constructed from. For example, a plastics material such as high density polyethylene, polypropylene and other types of plastic or metal may be molded to be used as a suitable elevation component.

Given that about 70% of a person's weight is typically supported by the center third of the length of a mattress, in some embodiments elevation components 65 may be placed in locations corresponding to the center third of the mattress length. The raised height provided by the elevation components allow the mattress to be raised, such that the raised portion (not shown) of the mattress provides additional contact and support to a user. For example, users requiring additional lumbar support may find that the raised portions in the lumbar area of the mattress helps alleviate pain. For users with other height preferences, the elevation members allow a user to easily customize their mattress. Additionally, the elevation components solve the issue of relying on the transverse mattress support members to provide an additional height, as the elevation components keep the overall weight of the mattress foundation low and alleviate the need for the transverse support members themselves to be of a taller height. Together with the elimination of the central longitudinally extending beams in the foundation structure, this allows for material costs to be kept low, and also allows for the overall weight of the mattress foundation to be significantly lower, which is a critical issue for shipping and transit of the foundation.

Thus as may be seen from the disclosure herein, a mattress foundation having a length and a width includes a first frame end assembly having a width corresponding with a width of a frame of the mattress foundation; a second frame end assembly having a width corresponding with the width of the frame of the mattress foundation; a pair of spaced-apart elongate side beam assemblies interconnecting the first and second frame end assemblies with each other, each side beam assembly extending in a lengthwise direction with respect to the mattress foundation, each side beam assembly having a pair of opposite ends, and each of the opposite ends of each of the side beam assemblies being interconnected with a respective one of the frame end assemblies; a plurality of transverse mattress support members extending between the side beam assemblies, each mattress support member having a pair of opposite ends, and a narrow surface and a wide surface, and each of the opposite ends being supported by a respective one of the side beam assemblies, where a plurality of hangers are mounted on each of the side beam assemblies and the hangers carry respective ends of the transverse mattress support members, where the narrow surface of the support members face upward; and a connector fastening each end of each side beam assembly to a respective one of the frame end assemblies, forming a frame of the mattress foundation.

Thus as may further be seen from the disclosure herein, a set of components for a mattress foundation suitable for supporting a mattress having a mattress length and a mattress width includes a first frame end assembly having a width corresponding with a width of the mattress foundation; a second frame end assembly having a width corresponding with the width of the mattress foundation; a first side beam assembly having a length less than the mattress length; a second side beam assembly having a length less than the mattress length; a plurality of transverse mattress support members each having a length and a pair of opposite ends; a plurality of mattress support member mounting devices including a plurality of hangers mounted on each of the side beam assemblies, where the hangers receive the supporting members; and a plurality of connectors each adapted to fasten a respective one of the first and second frame end assemblies to a respective one of the first and second side beam assemblies, to form a frame of the mattress foundation.

Thus as may further be seen from the disclosure herein, an embodiment of this disclosure of a mattress foundation having a length and a width includes a first frame end assembly and a second frame end assembly, the two end assemblies having a width corresponding to the width of the foundation, each end assembly having a pair of opposite ends and a pair of end-to-side beam assemblies perpendicularly extending from each opposite end, the end-to-side beam assemblies having a length that is less than one-third the length of the foundation; a pair of side beam assemblies, each side beam assembly extending in a lengthwise direction with respect to the mattress foundation, each side beam assembly having a pair of opposite ends, and each of the opposite ends being selectively connectable to a respective end of an end-to-side beam assembly; a plurality of connectors of molded plastic material having a length, opposing ends and a channel extending through the length, the channel being wide enough at the ends to incorporate each end of each side beam assembly to a respective one of the frame end assemblies; a plurality of transverse mattress support members each having a narrow surface, a wide surface in relation to the narrow surface, a length and a pair of opposite ends, where the support members extend between the side beam assemblies parallel to the foundation width, the narrow surface facing upwards so that the support members significantly resist bending downwardly under the weight of a person on a bed including the foundation, where the bending strength from the support members makes it unnecessary for the foundation to have a central longitudinally extending beam located in the center of the foundation and parallel with the length of the foundation; a plurality of hangers having a pair of parallel side members, a back member, and a bottom member, the side members and bottom member extending perpendicularly from the back member forming a pocket that is open upwardly and toward the interior of the foundation frame, in which to receive the end of a mattress support member, where the side members are trapezoidal in shape and wider at the bottom of the hanger so that the pocket is deeper at the bottom of the hanger; and an elevation component of a molded plastic material having a height and a width, the width corresponding to the width of the pocket of the hanger, where the elevation component is used to support and raise the transverse support members.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A mattress foundation having a length and a width, comprising:

(a) a first frame end assembly and a second frame end assembly, the two end assemblies having a width corresponding to the width of the foundation, each end assembly having a pair of opposite ends and a pair of end-to-side beam assemblies perpendicularly extending from each opposite end, the end-to-side beam assemblies having a length that is less than one-third the length of the foundation;

(b) a pair of side beam assemblies, each side beam assembly extending in a lengthwise direction with respect to the mattress foundation, each side beam assembly having a pair of opposite ends, and each of the opposite ends being selectively connectable to a respective end of an end-to-side beam assembly;

(c) a plurality of connectors of molded plastic material having a length, opposing ends and a channel extending through the length, the channel being wide enough at the ends to incorporate each end of each side beam assembly to a respective one of the frame end assemblies;

(d) a plurality of transverse mattress support members each having a narrow surface, a wide surface in relation to the narrow surface, a length and a pair of opposite ends, where the support members extend between the side beam assemblies parallel to the foundation width, the narrow surface facing upwards so that the support members significantly resist bending downwardly under the weight of a person on a bed including the foundation, where the bending strength from the support members makes it unnecessary for the foundation to have a central longitudinally extending beam located in the center of the foundation and parallel with the length of the foundation;

(e) a plurality of hangers having a pair of parallel side members, a back member, and a bottom member, the side members and bottom member extending perpendicularly from the back member forming a pocket that is open upwardly and toward the interior of the foundation frame, in which to receive the end of a mattress support member, where the side members are trapezoidal in shape and wider at the bottom of the hanger so that the pocket is deeper at the bottom of the hanger; and (f) an elevation component of a molded plastic material having a height and a width, the width corresponding to the width of the pocket of the hanger, where the elevation component is used to support and raise the transverse support members.

2. The mattress foundation of claim 1 wherein the pocket of the hanger extends through the top of the hanger such that the transverse support members may directly slide in without obstruction.

3. The mattress foundation of 2 wherein the surface of the channel has ribs extending longitudinally along the length of the connector.

4. The mattress foundation of claim 2 wherein at least two of the hangers are combined with a connector to form an integrated member.

5. The mattress foundation of claim 1 wherein the hanger includes an ear in the form of a singular strip that extends perpendicularly away from an upper end of the back member, wherein the ear is fastened in place by at least one heavy duty staple.

6. A plurality of mattress support member mounting devices used to support transverse mattress support members placed on top of a mattress foundation, including:

(a) a plurality of hangers having a pair of parallel side members, a back member, a bottom member, and an ear in the form of a singular strip that extends perpendicularly away from an upper end of the back member, the side members and bottom member extending perpendicularly from the back member forming a pocket that is open upwardly and toward the interior of the foundation, in which to receive the end of a mattress support member, where the side members are trapezoidal in shape and wider at the bottom of the hanger so that the pocket is deeper at the bottom of the hanger and extends through the top of the hanger to allow the transverse support members to directly slide in; and (b) an elevation component of a molded plastic material having a height and a width, the width corresponding to the width of the pocket of the hanger, where the elevation component is used to support and raise the transverse support members.

7. The set of components of claim 6 wherein the ear is fastened in place by at least one heavy duty staple.

8. The set of components of claim 6 wherein at least two of the hangers are combined with a connector of molded plastic material to form an integrated member, the connector having a length and opposing ends and a channel extending through the length.

9. The set of components of claim 6 wherein the surface of the channel has ribs extending longitudinally along the length of the connector.

* * * * *